US011060440B2

(12) United States Patent
Park et al.

(10) Patent No.: US 11,060,440 B2
(45) Date of Patent: Jul. 13, 2021

(54) INTEGRATED FLOW CONTROL VALVE AND ENGINE COOLING SYSTEM WITH THE SAME

(71) Applicants: Hyundai Motor Company, Seoul (KR); Kia Motors Corporation, Seoul (KR)

(72) Inventors: Cheol-Soo Park, Yongin-si (KR); Jun-Sik Park, Seoul (KR); Chang-Joo Lee, Seoul (KR); Dong-Suk Chae, Hwaseong-si (KR)

(73) Assignees: Hyundai Motor Company, Seoul (KR); Kia Motors Gorporation, Seoul (KR)

( * ) Notice: Subject to any disclaimer, the term of this patent is extended or adjusted under 35 U.S.C. 154(b) by 0 days.

(21) Appl. No.: 16/673,807

(22) Filed: Nov. 4, 2019

(65) Prior Publication Data

US 2020/0300152 A1 Sep. 24, 2020

(30) Foreign Application Priority Data

Mar. 21, 2019 (KR) ..... 10-2019-0032164

(51) Int. Cl.
*F01P 3/20* (2006.01)
*F01M 5/00* (2006.01)
(Continued)

(52) U.S. Cl.
CPC ..... *F01P 3/20* (2013.01); *F01M 5/002* (2013.01); *F01M 2005/004* (2013.01);
(Continued)

(58) Field of Classification Search
CPC ..... F01P 3/20; F01P 5/10; F01P 2003/027; F01P 2007/146; F01P 2050/22; F01P 2060/08; F01M 5/002; F01M 2005/004
(Continued)

(56) References Cited

U.S. PATENT DOCUMENTS

2012/0279462 A1* 11/2012 Warnery ..... F01P 11/16 123/41.08
2013/0167786 A1* 7/2013 Mehring ..... F01P 3/02 123/41.82 R (Continued)

FOREIGN PATENT DOCUMENTS

KR 10-1550981 B1 9/2015

OTHER PUBLICATIONS

Extended European Search Report dated Apr. 1, 2020 for European Patent Application No. 19207952.3.

*Primary Examiner* — Joseph J Dallo
*Assistant Examiner* — Yi-Kai Wang
(74) *Attorney, Agent, or Firm* — Morgan, Lewis & Bockius LLP

(57) ABSTRACT

An integrated flow control valve apparatus for controlling a flow rate of coolant in an engine cooling system for cooling an engine including a cylinder block and a cylinder head mounted above the cylinder block, includes a valve housing; a plurality of coolant ports formed at the valve housing and provided as inlets and outlets through which the coolant flows into and out of the valve housing; and valves configured for opening and closing the coolant ports, wherein the coolant ports include a first inlet port for introduction of the coolant from the cylinder block and a second inlet port for introduction of the coolant from the cylinder head into the valve housing; and the flow of the coolant at the first and second inlet ports is controlled by the valves configured to vary the flow of the coolant in the cylinder block and the cylinder head.

8 Claims, 19 Drawing Sheets

(51) Int. Cl.
*F01P 5/10* (2006.01)
*F01P 3/02* (2006.01)
*F01P 7/14* (2006.01)

(52) U.S. Cl.
CPC ..... *F01P 5/10* (2013.01); *F01P 2003/027* (2013.01); *F01P 2007/146* (2013.01); *F01P 2050/22* (2013.01); *F01P 2060/08* (2013.01)

(58) Field of Classification Search
USPC ..... 123/41.1
See application file for complete search history.

(56) References Cited

U.S. PATENT DOCUMENTS

| | | | | |
|---|---|---|---|---|
| 2013/0221116 | A1* | 8/2013 | Tsuchiya | G05D 23/134 236/34.5 |
| 2015/0027575 | A1* | 1/2015 | Morein | F01P 7/14 137/865 |
| 2015/0136380 | A1 | 5/2015 | Kim | |
| 2016/0010535 | A1 | 1/2016 | Lee | |
| 2016/0069248 | A1* | 3/2016 | Beyer | F01P 3/02 123/41.74 |
| 2016/0123218 | A1 | 5/2016 | Lee | |
| 2016/0215681 | A1* | 7/2016 | Brinkmann | F01P 7/165 |

* cited by examiner

INTEGRATED FLOW CONTROL VALVE AND ENGINE COOLING SYSTEM WITH THE SAME

CROSS-REFERENCE(S) TO RELATED APPLICATIONS

The present application claims priority to Korean Patent Application No. 10-2019-0032164, filed on Mar. 21, 2019, the entire contents of which is incorporated herein for all purposes by this reference.

BACKGROUND OF THE INVENTION

Field of the Invention

Exemplary embodiments of the present invention relates to an integrated flow control valve apparatus and an engine cooling system with the same, and more particularly, to an integrated flow control valve apparatus configured for generating a cross flow of coolant in an engine without a separate coolant chamber, and an engine cooling system with the same.

Description of Related Art

In a conventional engine, the temperature of coolant in a cylinder head and a cylinder block is regulated by a single coolant temperature regulation mechanism positioned at the inlet or outlet of the engine. As a result, the coolant temperature is similarly maintained in both the cylinder head and the cylinder block.

Increasing the temperature on the wall surface of the block cylinder reduces a piston friction loss, resulting in an improvement in fuel efficiency. However, if the temperature of the engine is increased as a whole to the present end, there is a problem, such as knocking, relating to combustion stability. Therefore, it is necessary to keep the upper temperature of the block relatively low to increase the combustion stability while keeping the lower temperature of the block high to reduce the piston friction loss.

In view of such a problem, a variable separation cooling technology has been developed for separately controlling coolant in a cylinder head and a cylinder block, as in Patent Document 1. On the other hand, a structure for separating the coolant from the cylinder head and the cylinder block may be provided for the variable separation cooling technology. For the present purpose, water holes in a head gasket are typically removed. In the instant case, since the temperature of the entire cylinder block needs to be increased, it is difficult to lower the upper temperature of the block. Furthermore, if the block temperature regulator fails, the coolant in the block is always stagnant which may lead to breakage of the entire engine.

To resolve the above problem in addition to the variable separation cooling technology, a so-called cross-flow method has been reviewed in which coolant flows across the exhaust side toward the intake side, instead of a conventional parallel-flow method in which coolant flows into parallel into water jackets of a cylinder block and head in the rear direction from the front of an engine. However, the cross-flow method is problematic in that a separate coolant chamber for generating a cross flow may be formed in the block of the conventional engine.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing an integrated flow control valve apparatus configured for generating a cross flow in a block without a separate coolant chamber and of separately cooling upper and lower portions of the block at low cost, and an engine cooling system with the same.

Other various aspects of the present invention may be understood by the following description, and become apparent with reference to the exemplary embodiments of the present invention. Also, it is obvious to those skilled in the art to which the present invention pertains that the objects and advantages of the present invention may be realized by the means as claimed and combinations thereof.

In accordance with various exemplary embodiments of the present invention, an integrated flow control valve apparatus is configured to control a flow rate of coolant in an engine cooling system for cooling an engine including a cylinder block and a cylinder head mounted above the cylinder block, and may include a valve housing, a plurality of coolant ports formed at the valve housing and provided as inlets and outlets through which the coolant flows into and out of the valve housing, and valves configured for opening and closing the coolant ports, wherein the coolant ports include a first inlet port for introduction of the coolant from the cylinder block and a second inlet port for introduction of the coolant from the cylinder head into the valve housing, and the flow of the coolant at the first and second inlet ports is controlled by the valves configured to vary the flow of the coolant in the cylinder block and the cylinder head. The cylinder head may be mounted above the cylinder block with a gasket interposed therebetween, the gasket having a coolant hole.

According to an exemplary embodiment of the present invention, it is possible to simply generate the cross and parallel flows of coolant in the engine only by controlling the opening and closing of the plurality of inlet ports using the integrated flow control valve apparatus.

The integrated flow control valve apparatus may be a rotary-type integrated flow control valve apparatus in which each of the valves is a cylindrical valve having a pipe structure which is hollow in a longitudinal center thereof and having at least any one coolant passage formed in a central space to fluidically communicate with one side of an external peripheral surface of the valve and the valve housing is a valve housing in which the cylindrical valve is mounted to be rotatable about a longitudinal center axis thereof.

The integrated flow control valve apparatus may be a cam lift-type integrated flow control valve apparatus that may include a cam provided in the valve housing and rotated by rotational force transmitted from a drive device coupled to the cam, and a plurality of pivot arms mounted in a lower portion of the cam, one end portions of the pivot arms moving vertically by the rotation of the cam. In the cam lift-type integrated flow control valve apparatus, the valves may be mounted at one end portions of the respective pivot arms and individually and vertically move along with the movement of the pivot arms by the rotation of the cam to selectively open and close the coolant ports.

In the rotary-type integrated flow control valve apparatus, the first and second inlet ports may be penetrated at positions spaced from each other by a predetermine angle on a cylindrical body of the valve housing, and the valve may have the coolant passage so that opening cross-sections of the first and second inlet ports vary as the valve rotates. In the instant case, the predetermined angle may be 180°.

In the cam lift-type integrated flow control valve apparatus, the cam may have a plurality of slopes configured such that the pivot arms move vertically as the cam rotates, and the slopes of the cam may be formed such that a second inlet port-side valve moves up to close the first inlet port when a first inlet port-side valve moves down and the first inlet port-side valve moves up to close the second inlet port when the second inlet port-side valve moves down.

The engine cooling system using the integrated flow control valve apparatus may include at least one of a radiator, a heater core, and an oil cooler, and a water pump for circulating the coolant, and the coolant ports of the integrated flow control valve apparatus may include a coolant outlet through which the coolant is discharged to at least any one of the radiator, the heater core, and the oil cooler.

The coolant ports may include a first outlet port through which the coolant is discharged to a radiator for releasing heat from the coolant to the atmosphere, and the first inlet port and the first outlet port may be mounted on the same layer of the valve housing when viewed from the side thereof. In the instant case, the first inlet port and the first outlet port may be formed such that an opening amount of the first inlet port is increased as an opening amount of the first outlet port is decreased.

The coolant ports may include a first outlet port through which the coolant is discharged to a radiator for releasing heat from the coolant to the atmosphere, and the second inlet port and the first outlet port may be mounted on the same layer of the valve housing when viewed from the side thereof. The second inlet port and the first outlet port may be formed such that an opening amount of the first outlet port is increased as an opening amount of the second inlet port is decreased.

In accordance with various exemplary embodiments of the present invention, an engine cooling system may include an engine including a cylinder block and a cylinder head mounted above the cylinder block, an integrated flow control valve apparatus into which coolant having cooled the cylinder block and coolant having cooled the cylinder head are selectively introduced through a plurality of coolant inlets and from which the coolant is selectively discharged through a coolant outlet so that the coolant circulates in the engine cooling system, and a controller configured to control opening and closing of the integrated flow control valve apparatus, wherein the controller controls the integrated flow control valve apparatus to block the introduction of the coolant from the cylinder head and allow the introduction of the coolant from the cylinder block in a predetermined high-speed and high-load operation range and to allow the introduction of the coolant from the cylinder head and block the introduction of the coolant from the cylinder block in a predetermined normal operating range. The cylinder head may be mounted above the cylinder block with a gasket interposed therebetween, the gasket having a coolant hole.

A block insert may be provided in a lower portion of a block water jacket of the cylinder block to partially restrict the flow of the coolant under the cylinder block.

The coolant outlet may include a plurality of coolant outlets, the plurality of coolant outlets may be connected to at least any one of a radiator, a heater core, and an oil cooler, and the engine cooling system may further include a water pump for circulating the coolant.

When the engine is in a cold state in which the temperature of the coolant is less than or equal to a first temperature, the controller of the engine cooling system may control the integrated flow control valve apparatus to close all the coolant outlets and stop the circulation of the coolant for rapid warm-up of the coolant.

When the engine is in a warm state in which the temperature of the coolant exceeds a first temperature and is less than or equal to a second temperature, the controller of the engine cooling system may control the integrated flow control valve apparatus to open a coolant outlet for discharging the coolant to the oil cooler or the heater core for efficient warm-up of oil and vehicle heating.

When the engine is in a hot state in which the temperature of the coolant exceeds a second temperature and is less than or equal to a third temperature, the controller of the engine cooling system may control the integrated flow control valve apparatus to open a coolant outlet for discharging the coolant to the radiator for cooling the coolant by the radiator.

When the engine is in a hot state in which the temperature of the coolant exceeds a third temperature, the controller of the engine cooling system may control the integrated flow control valve apparatus to close the coolant inlet for the introduction of the coolant from the cylinder head and open the coolant inlet for the introduction of the coolant from the cylinder block for realization the cross flow of the coolant in the engine.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
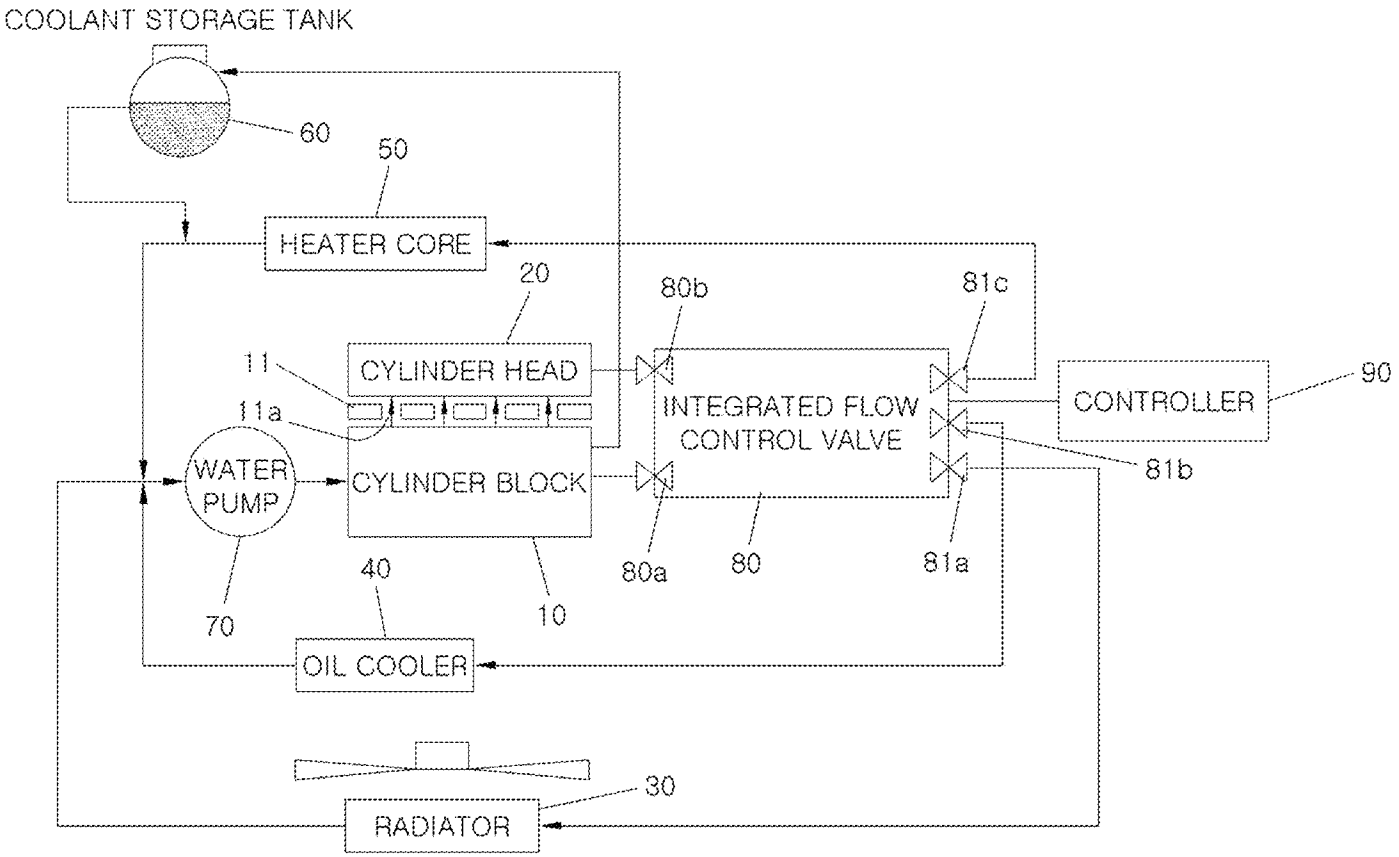
FIG. 1 is a block diagram illustrating an engine cooling system according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present invention will be described below in more detail with reference to the accompanying drawings. The present invention may, however, be embodied in different forms and may not be construed as limited to the exemplary embodiments set forth herein. Rather, these embodiments are provided so that the present disclosure will be thorough and complete, and will fully convey the scope of the present invention to those skilled in the art. Throughout the disclosure, like reference numerals refer to like parts throughout the various figures and embodiments of the present invention.

FIG. 1 is a block diagram illustrating an engine cooling system according to an exemplary embodiment of the present invention. As illustrated in FIG. 1, the engine cooling system according to the exemplary embodiment of the present invention includes an engine, which includes a cylinder block 10 and a cylinder head 20 mounted above the cylinder block 10 with a gasket 11, having a coolant hole 11*a*, interposed therebetween, an integrated flow control valve apparatus 80 into which the coolant having cooled the cylinder block 10 and the coolant having cooled the cylinder head 20 are selectively introduced through a plurality of coolant inlet ports 80*a* and 80*b* and from which the coolant is selectively discharged through a plurality of coolant outlet ports 81*a*, 81*b*, and 81*c* so that the coolant circulates in the engine cooling system, and a controller 90 for controlling the opening and closing of the integrated flow control valve apparatus 80.

The engine cooling system also includes a radiator 30, an oil cooler 40, a heater core 50, a coolant storage tank 60, and a water pump 70, as illustrated in FIG. 1.

The oil cooler 40 is configured to cool or heat oil by the coolant supplied thereto, and the heater core 50 is configured to heat air inside a vehicle by the coolant supplied thereto. The radiator 30 is configured to cool coolant by releasing high-temperature heat from the coolant to the outside. The coolant storage tank 60 is configured to store coolant replenished from outside, and the water pump 70 is configured to pump the coolant stored in the coolant storage tank 60 and supply it into the engine cooling system.

The coolant stored in the coolant storage tank 60 is pumped by the water pump 70 and then supplied to the block water jacket in the cylinder block 10 to cool the cylinder block 10. Some of the coolant supplied to the block water jacket is supplied to the head water jacket in the cylinder head 20 through the coolant hole 11*a* of the gasket 11 to cool the cylinder head 20.

After the engine is cooled, the coolant discharged from the cylinder block 10 is supplied to the integrated flow control valve apparatus 80 through the first inlet port 80*a* and the coolant discharged from the cylinder head 20 is supplied to the integrated flow control valve apparatus 80 through the second inlet port 80*b*.

The coolant discharged through the first outlet port 81*a* of the integrated flow control valve apparatus 80 is supplied to the radiator 30 so that the coolant is air-cooled by a cooling fan or the like, and then supplied back to the water pump 70. The coolant discharged through the second outlet port 81*b* of the integrated flow control valve apparatus 80 is supplied to the oil cooler 40 so that the coolant is used to heat or cool oil for an automatic transmission, and then supplied back to the water pump 70. The coolant discharged through the third outlet port 81*c* of the integrated flow control valve apparatus 80 is supplied to the heater core 50 so that the coolant is used to heat the internal of the vehicle, and then supplied back to the water pump 70. Alternatively, some of the coolant discharged through the third outlet port 81*c* of the integrated flow control valve apparatus 80 may be used to cool a throttle body which is not shown.

The controller 90 controls the integrated flow control valve apparatus 80 to adjust the opening amounts of the inlet ports 80*a* and 80*b* and the outlet ports 81*a*, 81*b*, and 81*c*. This makes it possible to selectively control the flow rate of the coolant introduced into and discharged from the integrated flow control valve apparatus 80.

The integrated flow control valve apparatus 80 is a valve that integrally controls the flow rate of the coolant supplied to or discharged from a plurality of cooling components forming the engine cooling system, and examples thereof include a rotation valve type and a cam lift type (poppet valve type). The specific configuration of the integrated flow control valve apparatus 80 will be described later.

In an exemplary embodiment of the present invention, it is possible to generate the cross flow of coolant in the engine using the integrated flow control valve apparatus 80 without a separate coolant chamber and to easily switch the cross flow and the parallel flow. Hereinafter, a method of generating the parallel flow and cross flow of coolant in the engine of the engine cooling system according to an exemplary embodiment of the present invention will be described in detail with reference to FIGS. 2A to 3B.

Figure 2A:
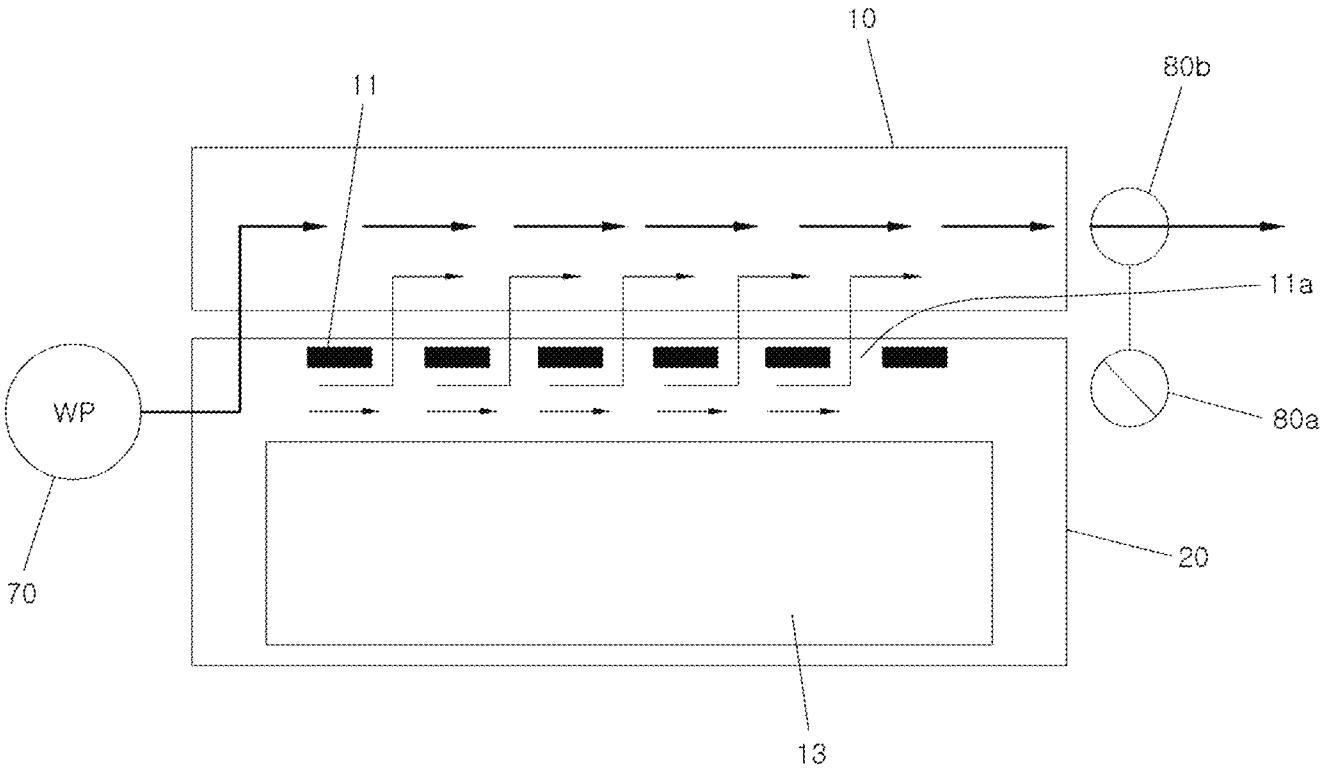
FIG. 2A is a diagram illustrating a parallel flow of coolant in an engine of the cooling system according to the exemplary embodiment of the present invention, when viewed from the side thereof.
Figure 2B:
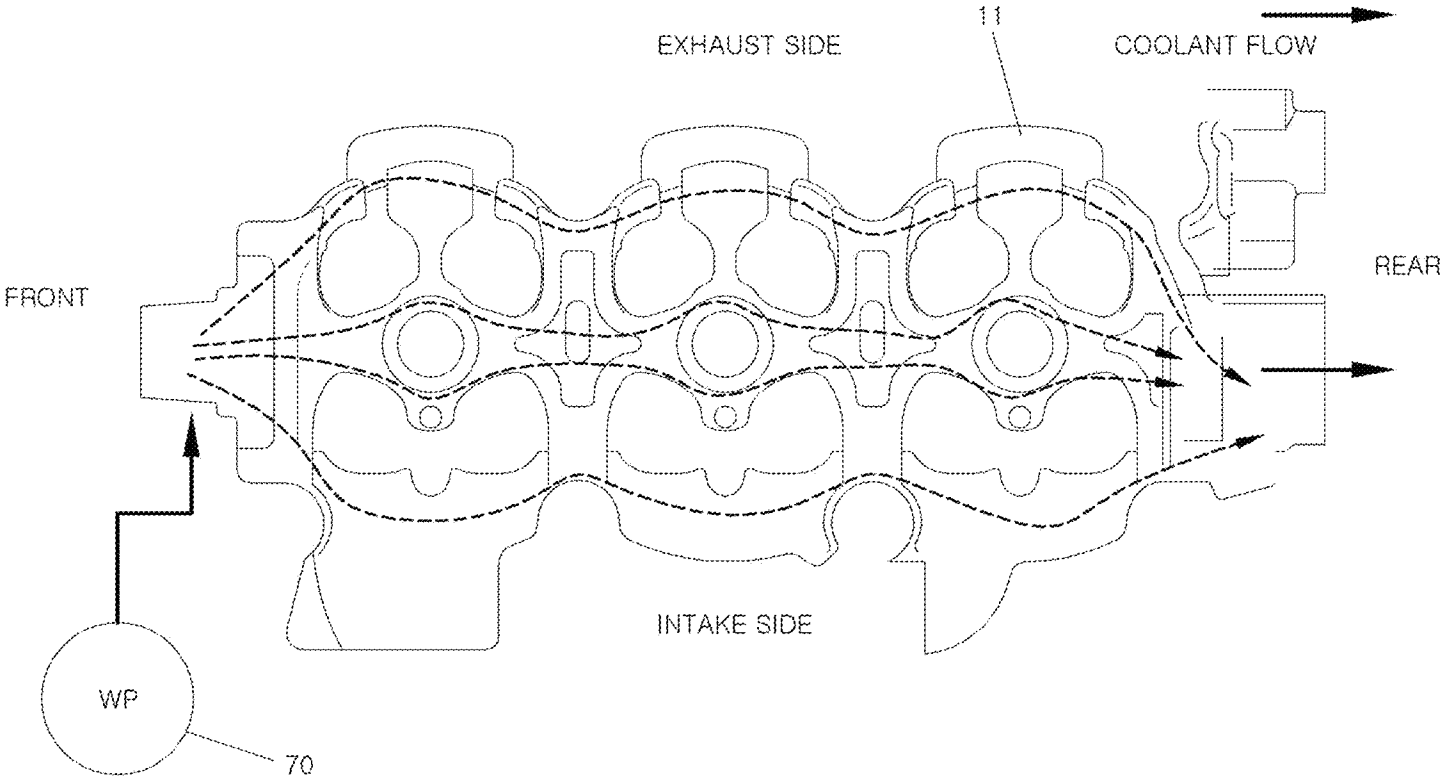
FIG. 2B is a diagram illustrating a parallel flow of coolant in a cylinder head of the cooling system according to the exemplary embodiment of the present invention, when viewed from the top.

FIG. 2A is a diagram illustrating the parallel flow of coolant in the engine of the cooling system according to the exemplary embodiment of the present invention, when viewed from the side thereof. FIG. 2B is a diagram illustrating the parallel flow of coolant in the cylinder head of the cooling system according to the exemplary embodiment of the present invention, when viewed from the top.

In a practical operating range, it is more important to improve fuel efficiency rather than combustion stability or engine durability. Therefore, it is necessary to reduce a friction loss of the piston by forming a strong warm block in the cylinder block, especially in the lower portion of the cylinder block, in addition to further cooling the cylinder head. To the present end, the present invention generates the parallel flow of coolant in the engine when the engine operates in the normal practical operating range.

As illustrated in FIG. 2A and FIG. 2B, the controller 90 controls the integrated flow control valve apparatus 80 to close the first inlet port 80*a,* through which coolant is introduced from the cylinder block 10 to the integrated flow control valve apparatus 80, while opening the second inlet port 80*b,* through which coolant is introduced from the cylinder head 20 to the integrated flow control valve apparatus 80, to generate the parallel flow of the coolant.

In the instant case, the discharge of the coolant from the cylinder block 10 to the outside is interrupted, so that the coolant is stagnant in the block water jacket of the cylinder block 10. Furthermore, the block water jacket in the lower portion of the cylinder block 10 is provided with a block insert 13 formed to surround a cylinder liner, suppressing the flow of the coolant to the lower portion of the cylinder block 10. Thus, some of the coolant flowing along the upper portion of the block insert 13 is supplied to the cylinder head 20 through the coolant hole 11*a*. As a result, the strong warm block is formed in the lower portion of the cylinder block 10, resulting in an increase in the temperature of the wall surface of the cylinder liner. Furthermore, the friction loss of the piston is reduced by the increase in the temperature of the wall surface of the cylinder line, resulting in an improvement of fuel efficiency. Furthermore, the cooling efficiency above the block insert 13 is enhanced compared to that in the lower portion of the block mounted with the block insert 13 since the coolant flows toward the cylinder head 20 above the block insert 13. As a result, it is possible to secure combustion stability to a certain extent by suppressing knocking. Furthermore, even when the coolant is overheated due to the stagnation of the coolant in the lower portion of the block, the overheated coolant may exchange heat with the coolant in the upper portion of the block by convection, preventing the boiling of the coolant.

On the other hand, since the coolant is smoothly discharged from the cylinder head 20 to the outside, the flow of the coolant is accelerated in the intake-side head water jacket adjacent to the cylinder head 20, especially to the coolant outlet of the cylinder head 20. Furthermore, since the coolant flows from the cylinder block 10 to the cylinder head 20 as described above, a large amount of coolant flows into parallel at a high speed in the cylinder head-side block water jacket. As a result, the cooling at the intake port of the cylinder head and the intake side of the combustion chamber is increased so that the knocking may be suppressed.

Since the parallel flow of coolant in the cylinder block 10 is significantly suppressed, it is possible to separately cool the cylinder block 10 and the cylinder head 20. This separation cooling effect may be close to the level of about 80 to 90% level compared to the conventional variable separation cooling method.

Unlike the practical operating range, it is more important to secure combustion stability or engine durability due to the overheating of the engine in a high-temperature and high-load operating range. Therefore, it is necessary to enhance the cooling between the exhaust valves of the cylinder head 20 in addition to enhancing the cooling of the upper side of the cylinder block 10 and to reduce the difference in temperature between the combustion chambers. To the present end, the present invention generates the cross flow of coolant in the engine when the engine operates in the high-temperature and high-load operating range.

Figure 3A:
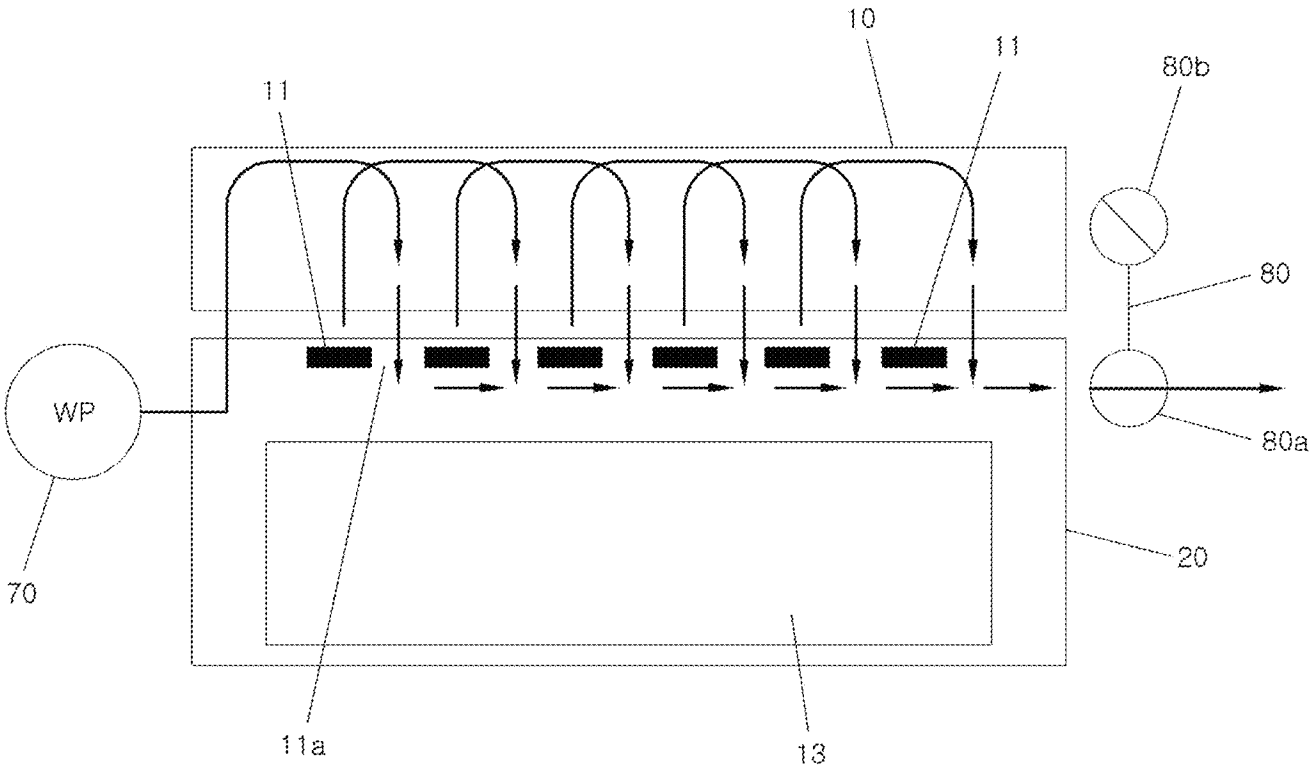
FIG. 3A is a diagram illustrating a cross flow of coolant in the engine of the cooling system according to the exemplary embodiment of the present invention, when viewed from the side thereof.
Figure 3B:
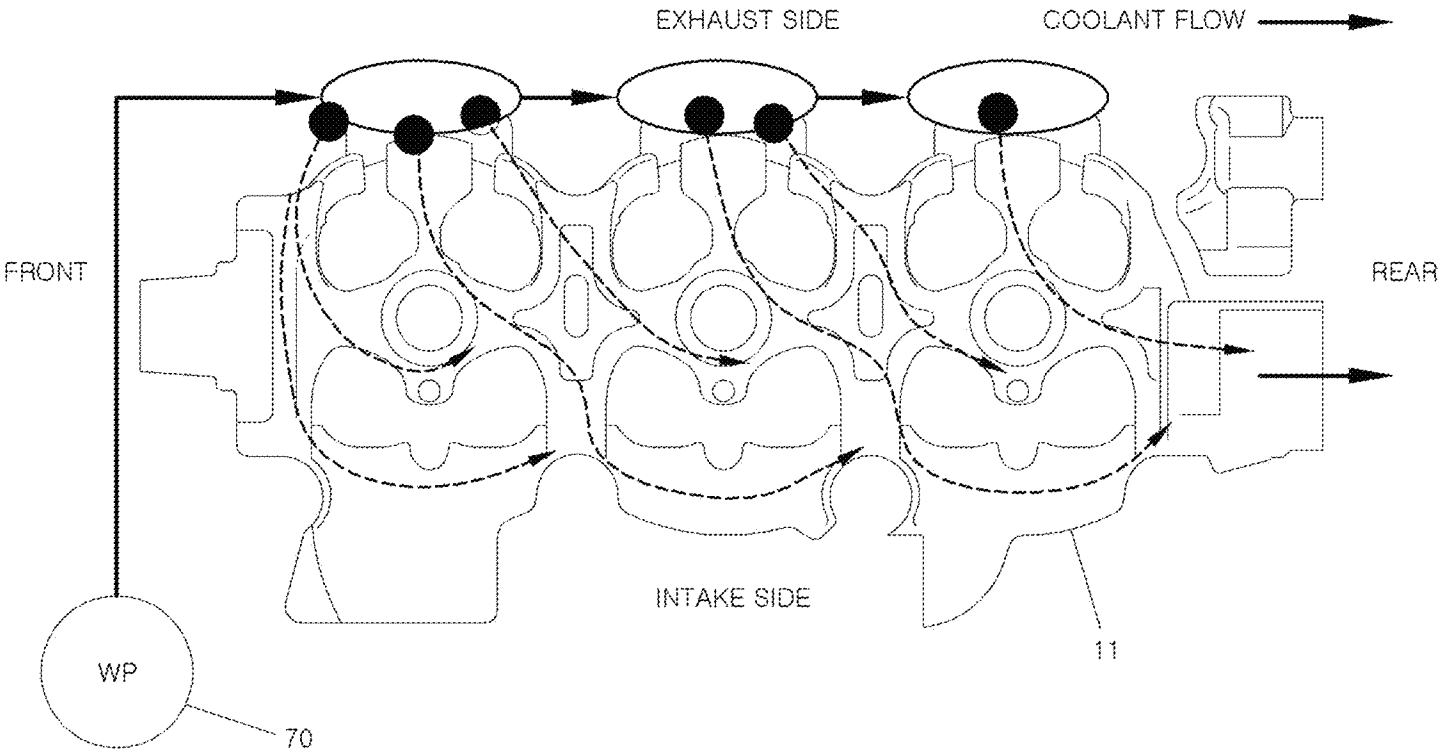
FIG. 3B is a diagram illustrating a cross flow of coolant in the cylinder head of the cooling system according to the exemplary embodiment of the present invention, when viewed from the top.

FIG. 3A is a diagram illustrating the cross flow of coolant in the engine of the cooling system according to the exemplary embodiment of the present invention, when viewed from the side thereof. FIG. 3B is a diagram illustrating the cross flow of coolant in the cylinder head of the cooling system according to the exemplary embodiment of the present invention, when viewed from the top.

As illustrated in FIG. 3A and FIG. 3B, the controller 90 controls the integrated flow control valve apparatus 80 to open the first inlet port 80*a,* through which coolant is introduced from the cylinder block 10 to the integrated flow control valve apparatus 80, while opening the second inlet port 80*b,* through which coolant is introduced from the cylinder head 20 to the integrated flow control valve apparatus 80, to generate the cross flow of the coolant in the high-temperature and high-load condition.

In the instant case, the discharge of the coolant from the cylinder head 20 to the outside is interrupted and the coolant introduced into the engine is discharged from the coolant outlet provided to the intake side of the cylinder block 10, so that the flow of the coolant is accelerated in the intake-side block water jacket of the cylinder block 10. As a result, the coolant flows from the exhaust side to the intake side in the head water jacket and the coolant flows from the head water jacket through the intake-side coolant hole 11*a* to the block water jacket of the cylinder block 10. That is, the cross flow occurs in the coolant flows in the exhaust side to the intake side across the upper portion of the combustion chamber.

In the instant case, the flow rate of the coolant flowing along the upper portion of the block insert 13 is increased and the coolant is introduced from the cylinder head 20, with the consequence that an effect of the warm block is weakened due to the stagnation of the coolant in the lower portion of the block, compared to that in the parallel flow. However, it is possible to suppress the flow of the coolant toward the lower portion of the block to a certain extent by providing the block insert 13, which makes it possible to obtain an effect of the warm block of 30 to 50% as compared with the conventional variable separation cooling method. Furthermore, since the flow of coolant is accelerated in the upper portion of the block, it is possible to enhance the cooling of the upper portion of the block, suppress knocking, and improve engine durability.

By the cross flow of the coolant across the intake and exhaust sides in the cylinder head 20, the cooling in the region between the exhaust valves may be enhanced as illustrated in FIG. 3B. As a result, since the temperature in the region between the exhaust valves is reduced by about 15 to 20° C., it is possible to improve the durability of the engine and decrease the maximum temperature of the combustion chamber. Furthermore, since the difference in temperature between the combustion chambers is reduced compared to the parallel flow in which the coolant flows into parallel from the first cylinder to the fourth cylinder, it is possible to improve knocking stability.

Hereinafter, the specific configuration of the integrated flow control valve apparatus according to the exemplary embodiment of the present invention will be described in detail with reference to FIG. 4, FIG. 5, FIG. 6, and FIG. 7.

Figure 4:
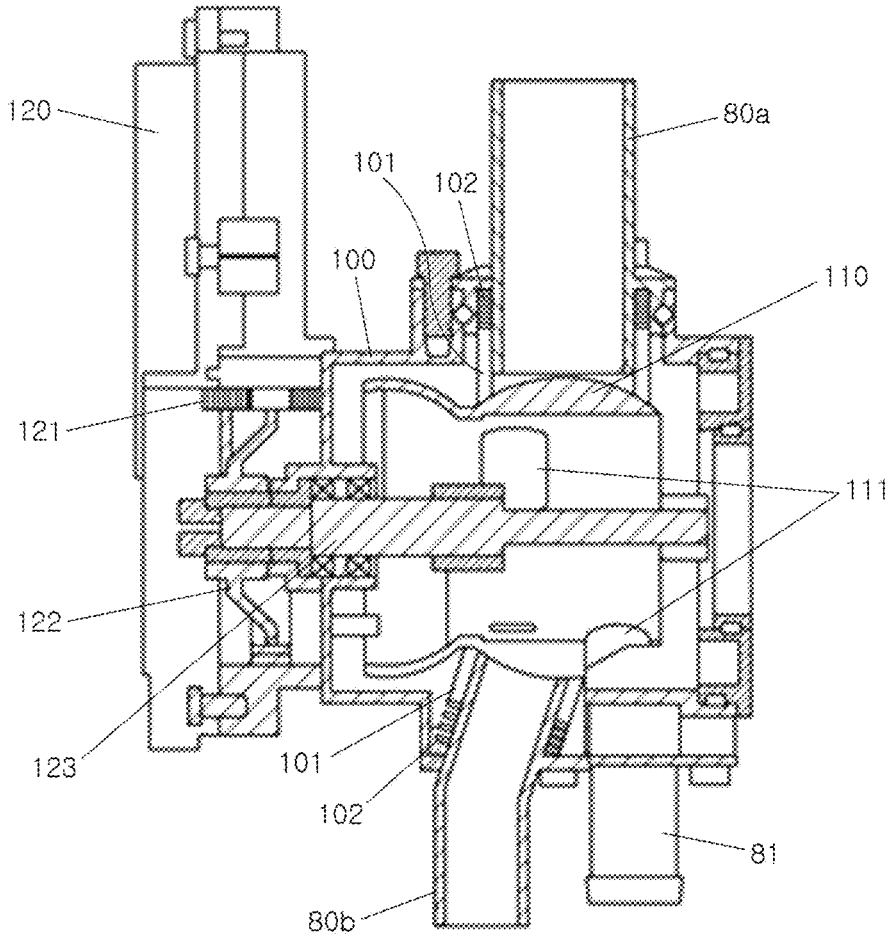
FIG. 4 is a cross-sectional view exemplarily illustrating an integrated flow control valve apparatus according to an exemplary embodiment of the present invention.
Figure 5A:
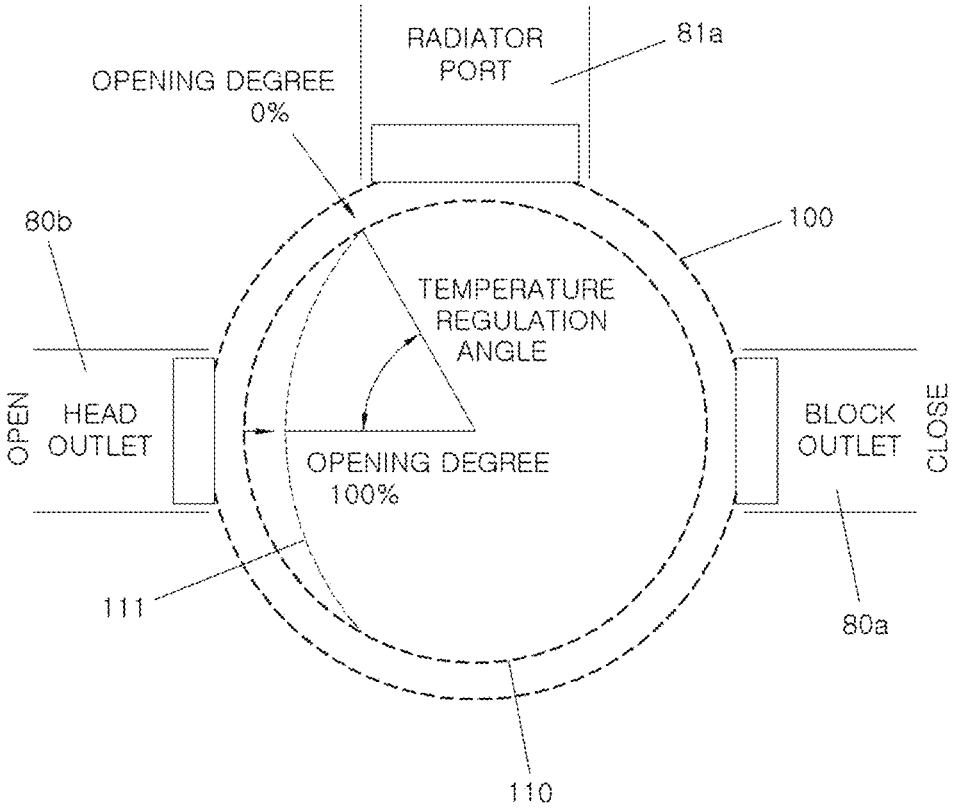
FIG. 5A and FIG. 5B are diagrams illustrating a positional relationship between a plurality of coolant ports in the integrated flow control valve apparatus of FIG. 4, when viewed from the front.
Figure 5B:
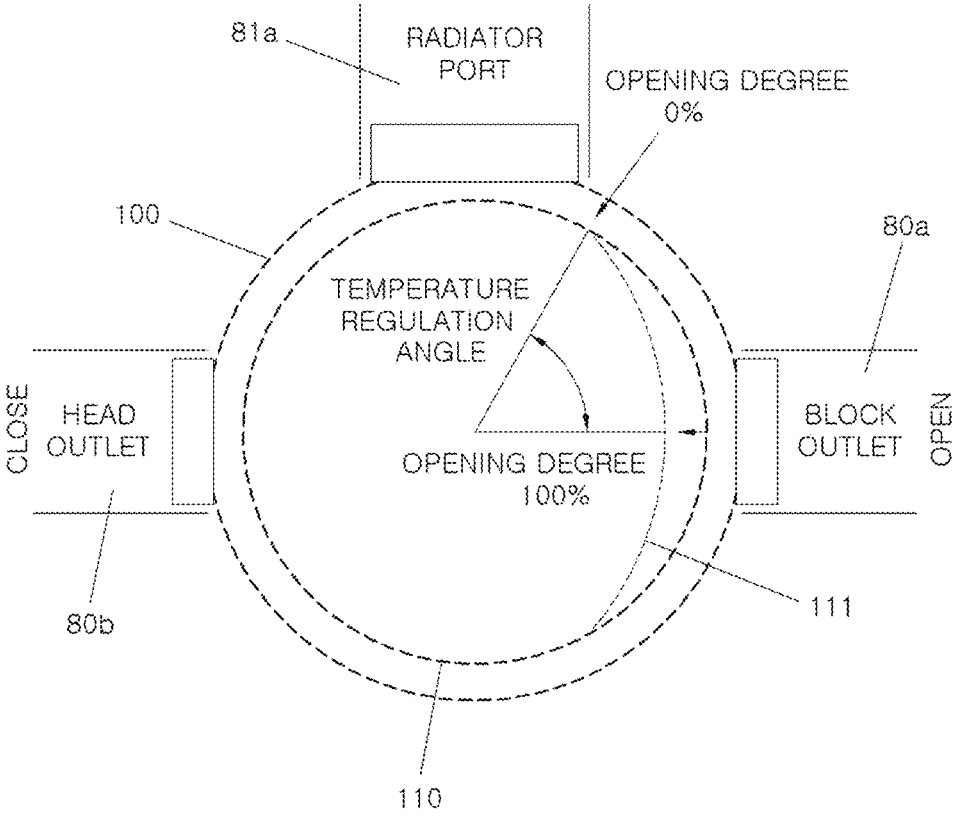

FIG. 4 is a cross-sectional view exemplarily illustrating an integrated flow control valve apparatus 100 according to an exemplary embodiment of the present invention. FIG. 5A and FIG. 5B are diagrams illustrating the positional relationship between a plurality of coolant ports in the integrated flow control valve apparatus of FIG. 4, when viewed from the front. The integrated flow control valve apparatus 100 illustrated in FIGS. 4, 5A, and 5B is a rotary-type integrated flow control valve apparatus.

Referring to FIG. 4, the integrated flow control valve apparatus 100 includes a motor housing 120 provided with a drive motor, an output gear 121 rotated by the drive motor, and a driven gear 122 rotated by the output gear 121, and the driven gear 122 rotates a cylindrical valve 110.

The cylindrical valve 110 has a pipe-shaped hollow structure, and has a space defined in the longitudinal center portion thereof. The cylindrical valve 110 has a coolant passage 111 formed in the central space to fluidically communicate with the external surface thereof.

A plurality of inlet ports 80*a* and 80*b* and outlet ports 81 are mounted on the external peripheral surface of integrated flow control valve apparatus 100 having the cylindrical valve 110 mounted therein, and the motor housing 120 is connected to one end portion of integrated flow control valve apparatus 100. The first inlet port 80*a* is connected to the coolant outlet of the cylinder block 10 of the engine, and the second inlet port 80*b* is connected to the coolant outlet of the cylinder head 20 of the engine. The outlet ports 81 may be respectively connected to the radiator 30, the oil cooler 40, the heater core, and the like forming the above-mentioned engine cooling system. Although only one outlet port 81 is illustrated due to the limitation of the drawing in FIG. 4, a plurality of outlet ports may be formed according to the number of cooling components connected to the integrated flow control valve apparatus 100.

A sealing member 101 is mounted on the external peripheral surface of the cylindrical valve 110, and an elastic member 102 resiliently pushes the sealing member 101 toward the external peripheral surface of the cylindrical valve 110 to form a sealing structure.

The controller 90 controls the drive motor in the motor housing 120 according to the operation condition, as described above, to rotate the cylindrical valve 110 about a rotation shaft 123, which is mounted along the longitudinal center axis thereof, through the output gear 121 and the driven gear 122.

As illustrated in FIG. 5A and FIG. 5B, when the cylindrical valve 110 rotates, the coolant passage 111 formed in the cylindrical valve 110 also rotates and the opening cross sections of the ports differ from each other according to the degree of overlap between the coolant passage 111 and the plurality of inlet ports 80*a* and 80*b* and outlet ports 81.

When the coolant passage 111 corresponds to the inlet ports 80*a* and 80*b* and the outlet ports 81 while the cylindrical valve 110 rotates, coolant is introduced from or discharged to the cooling components connected to the inlet ports or the outlet ports.

As illustrated in FIG. 5A and FIG. 5B, the first inlet port 80*a* communicating with the cylinder block 10 and the second inlet port 80*b* communicating with the cylinder head 20 are formed at positions spaced from each other by a predetermined angle on the cylindrical body of the cylindrical valve 110. In a predetermined rotation angle range of the cylindrical valve 110, the first inlet port 80*a* is closed and the second inlet port 80*b* is opened. On the other hand, in another on the cylindrical body of the cylindrical valve 110, the first inlet port 80*a* is opened and the second inlet port 80*b* is closed. Thus, the above-mentioned parallel and cross flows of coolant may be generated using the integrated flow control valve apparatus 100. The predetermined angle is 180°.

As illustrated in FIG. 5A and FIG. 5B, the integrated flow control valve apparatus 100 has a first outlet port 81*a* for releasing coolant to the radiator 30, and the first and second inlet ports 80*a* and 80*b* and the first outlet port 81*a* are mounted on the same layer of the valve housing when viewed from the side thereof.

In the instant case, as illustrated in FIG. 5A, when the cylindrical valve 110 rotates in the clockwise direction with the opening amount of the first inlet port 80*a* being 100%, the opening amount of the second inlet port 80*b* is gradually decreased and the opening amount of the first outlet port 81*a* is gradually increased. When the cylindrical valve 110 further rotates, the opening amount of the second inlet port 80*b* is 0% (i.e., closed state). Therefore, it is possible to reduce the flow rate of the coolant discharged from the cylinder head 20 while increasing the flow rate of the coolant supplied to the radiator 30.

As illustrated in FIG. 5B, when the cylindrical valve 110 further rotates in the clockwise direction thereof, the first inlet port 80*a* begins to be opened. When the cylindrical valve 110 further rotates after the first inlet port 80*a* is opened, the opening amount of the first outlet port 81*a* is decreased and the opening amount of the first inlet port 80*a* is increased. When the opening amount of the first inlet port 80*a* reaches the maximum, the first outlet port 81*a* is closed. Therefore, it is possible to increase the flow rate of the coolant discharged from the cylinder block 10 while reducing the flow rate of the coolant supplied to the radiator 30.

Figure 6:
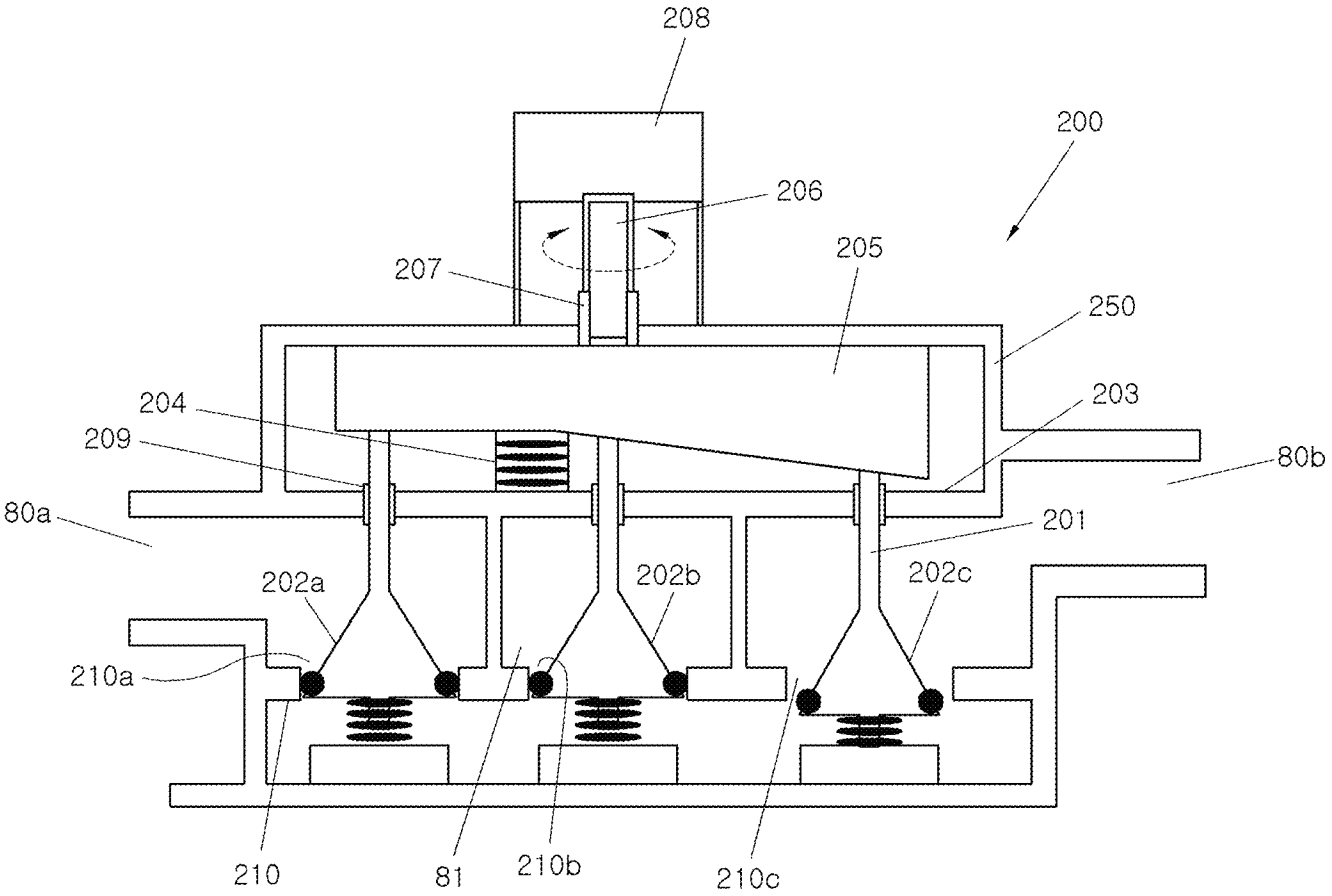
FIG. 6 is a cross-sectional view exemplarily illustrating an integrated flow control valve apparatus according to various exemplary embodiments of the present invention.
Figure 7:
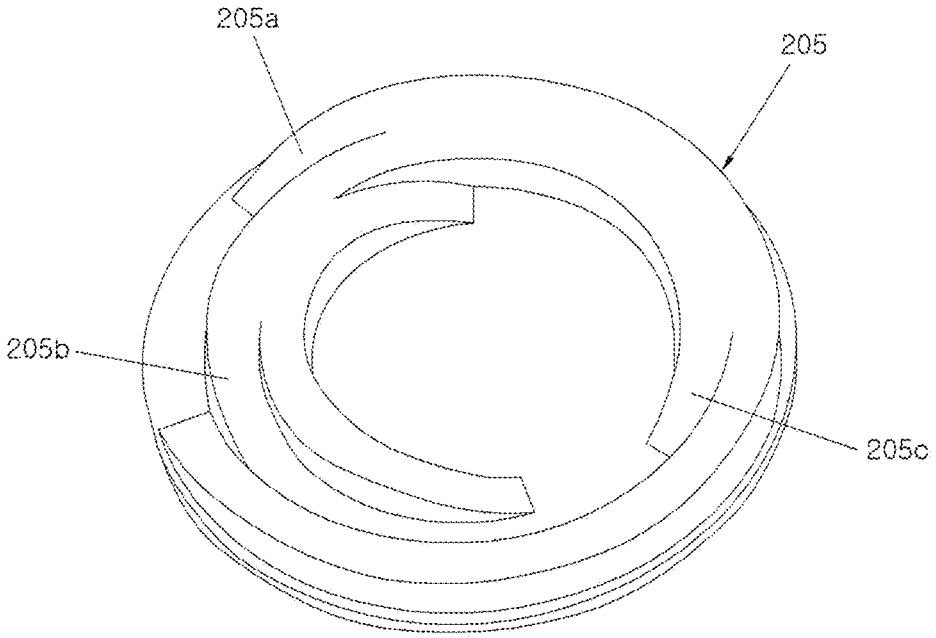
FIG. 7 is a perspective view exemplarily illustrating a cam of the integrated flow control valve apparatus of FIG. 6.

FIG. 6 is a cross-sectional view exemplarily illustrating an integrated flow control valve apparatus 200 according to various exemplary embodiments of the present invention. FIG. 7 is a perspective view exemplarily illustrating a cam of the integrated flow control valve apparatus of FIG. 6. The integrated flow control valve apparatus 200 illustrated in FIG. 6 and FIG. 7 is a cam lift-type integrated flow control valve apparatus.

Referring to FIG. 6, the integrated flow control valve apparatus 200 includes a cam 205, a plurality of pivot arms 201, a plurality of valves 202*a*, 202*b*, 202*c*, etc., and a valve housing 250.

The cam 205 is connected to one end portion of a shaft 206 extending upwards from the center portion of the cam 205 by a drive means such as a motor 208 and rotates by the driving force transmitted from the drive means. The pivot arms 201 are operated along with the rotation of the cam 205 to drive the valves 202*a*, 202*b*, 202*c*, etc. To the present end, as illustrated in FIG. 7, slopes 205*a*, 205*b*, 205*c*, etc. having the same number of pivot arms 201 are provided in the lower portion of the cam 205. The inclined surfaces of the slopes 205*a*, 205*b*, 205*c*, etc. press the upper end portions of the pivot arms 201 according to the rotation of the cam 205 to move down the pivot arms 201.

The plurality of pivot arms 201 corresponding to the number of inlet and outlet ports formed in the integrated flow control valve apparatus 200 are mounted in the lower portion of the cam 205, and rotate along with the rotation of the cam 205 to move up.

The valve housing 250 is a space for accommodating the components of the integrated flow control valve apparatus 200. The valve housing 250 includes inlet ports, such as a first inlet port 80*a* into which coolant is introduced from the cylinder block 10 and a second inlet port 80*b* into which coolant is introduced from the cylinder head 20, and a plurality of outlet ports 81 from which coolant is discharged to the constituent cooling components of the engine cooling system. Although only one outlet port 81 is illustrated due to the limitation of the drawing in FIG. 6, a plurality of outlet ports may be formed according to the number of cooling components connected to the integrated flow control valve apparatus 200.

The valve housing 250 has a through-hole formed in the upper portion thereof such that the shaft 206 of the cam 205 passes through the through-hole, and the through-hole is mounted with a bearing 207 for rotatably supporting the shaft 206.

The valve housing 250 is partitioned into a space, in which the cam 205 is mounted, and a lower space by a plate 203. A compression spring 204 is provided on the external surface of the plate 203 to press and support the cam 205 upward. The plate 203 has installation holes for guiding the installation positions of the respective pivot arms 201, and the respective installation holes are provided with bearings 209 for slidably supporting the pivot arms 201.

A fixed portion 210 is formed under the plate 203 and has passages 210*a*, 210*b*, and 210*c* opened and closed by the valves 202*a*, 202*b*, 202*c*, etc. The passages 210*a*, 210*b*, and 210*c* are passages through which a fluid is into the integrated flow control valve apparatus 200 through the inlet ports 80*a*, 80*b*, etc. and the outlet ports 81, etc., and are opened and closed by the corresponding valves 202*a*, 202*b*, 202*c*, etc.

The internal space of the valve housing 250 between the plate 203 and the fixed portion 210 is partitioned into spaces corresponding to the number of poppet valves provided therein by the partition wall extending between the plate 203 and the fixed portion 210. The partitioned spaces are sealed by the partition wall to prevent the fluid from communicating with the spaces. The outlet ports 81, etc. Are provided in the partitioned spaces, respectively, to fluidically communicate with the radiator 30, the oil cooler 40, and the heater core 50 of the engine cooling system, so that the coolant introduced from the inlet ports 80*a* and 80*b* flows to the radiator 30, the oil cooler 40, and the heater core 50 of the engine cooling system through the outlet ports 81, etc.

The slopes 205*a*, 205*b*, 205*c*, etc. of the cam 205 are set such that the second inlet port 80*b* is opened by the valve 202*c* when the valve 202*c* is operated to close the first inlet port 80*a*. On the other hand, the slopes 205*a*, 205*b*, 205*c*, etc. of the cam 205 are set such that the second inlet port 80*b* is closed by the valve 202*c* when the valve 202*c* is operated to open the first inlet port 80*a*. Thus, the above-mentioned parallel and cross flows of coolant may be generated using the integrated flow control valve apparatus 200.

FIG. 8A, FIG. 8B, FIG. 8C, and FIG. 8D are diagrams illustrating a coolant flow according to the engine operation condition in the engine cooling system of the exemplary embodiment of the present invention. In the drawings, the region in which coolant flows is indicated by the bold line.

Figure 8A:
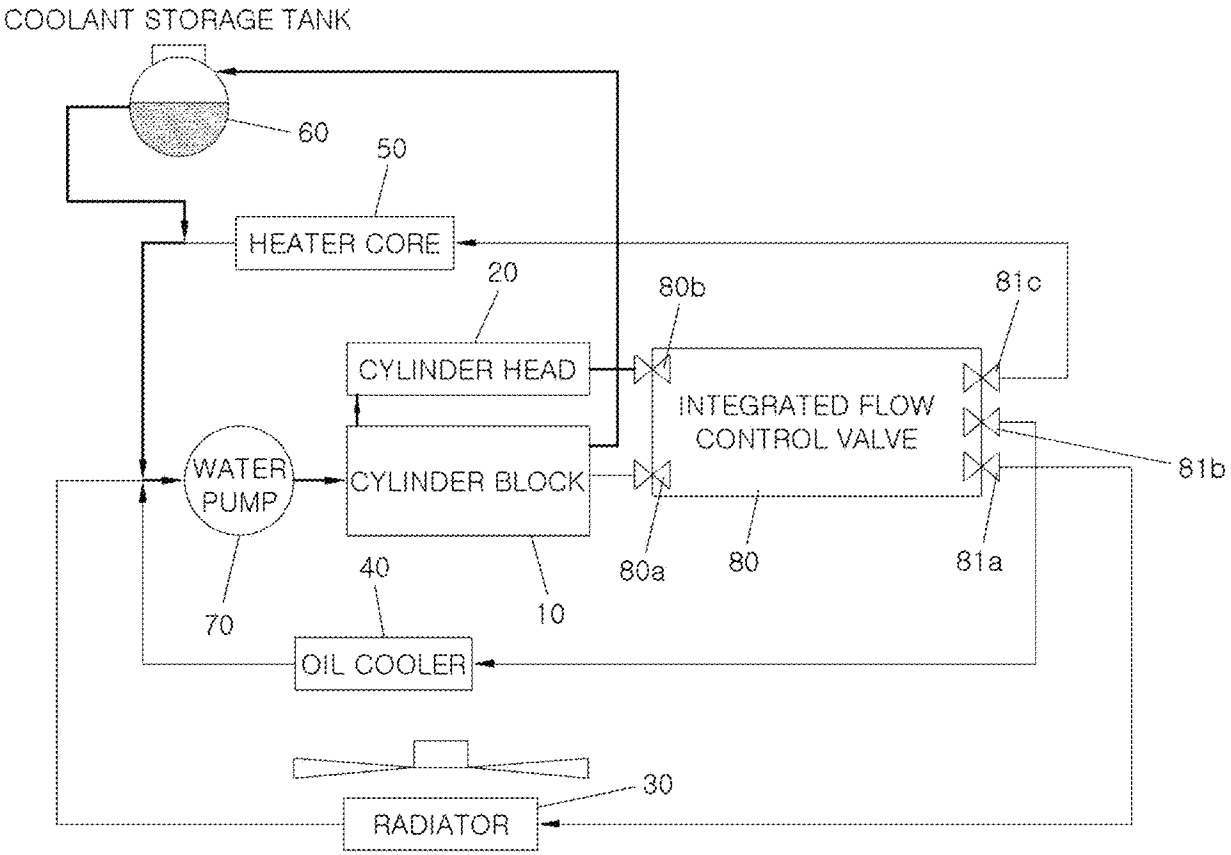
FIG. 8A, FIG. 8B, FIG. 8C, and FIG. 8D are diagrams illustrating a coolant flow according to the engine operation condition in the engine cooling system of the exemplary embodiment of the present invention.

FIG. 8A is a diagram illustrating a coolant flow when the engine is operated in a cold condition. When the temperature of coolant is in the cold state of the engine which is less than or equal to a first temperature (e.g., the temperature of the coolant is approximately 50° C. or less), it is necessary to stop the flow of the coolant for rapid warm-up and increase the temperature of the coolant as rapidly as possible. Therefore, the controller 90 controls the integrated flow control valve apparatus 80 to close all the outlet ports 81*a*, 81*b*, and 81*c* of the integrated flow control valve apparatus 80.

Figure 8B:
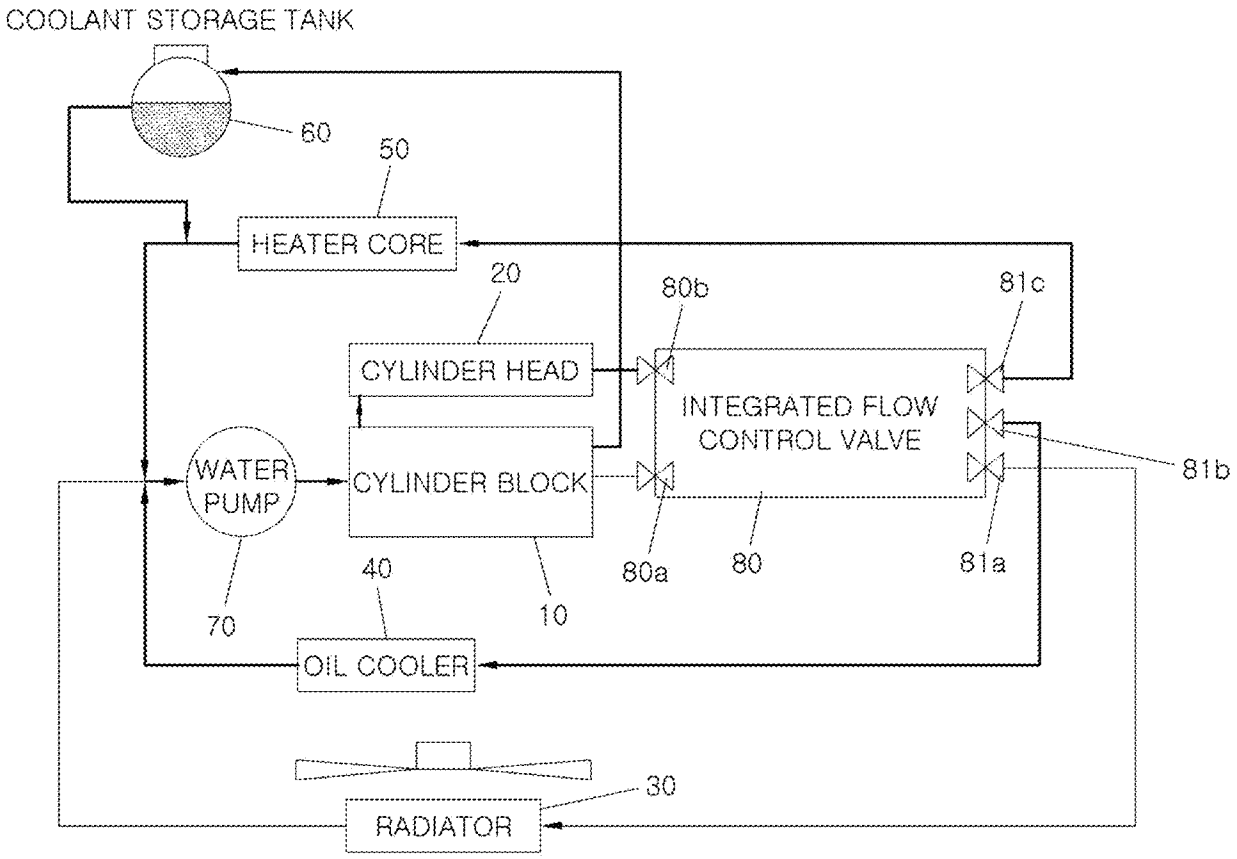

FIG. 8B is a diagram illustrating an example of the coolant flow when the operation condition of the engine is switched from a cold condition to a warm condition. This is a state in which the temperature of coolant exceeds a first temperature and is less than or equal to a second temperature (e.g., higher than 50° C. and less than or equal to 90° C.). When the engine is in the warm state in which the temperature of the coolant is increased than that of FIG. 8A, the coolant, the temperature of which is increased, flows to the oil cooler 40 to reduce the friction within the engine and improve fuel efficiency and engine performance. Furthermore, when the heater is in operation for heating the vehicle, the coolant, the temperature of which is increased, flows to the heater core 50 to improve fuel efficiency and engine performance. Thus, the controller 90 controls the integrated flow control valve apparatus 80 to open at least one of the second and third outlet ports 81*b* and 81*c* connected to the oil cooler 40 and the heater core 50 from among the plurality of outlet ports 81*a*, 81*b*, and 81*c*.

Figure 8C:
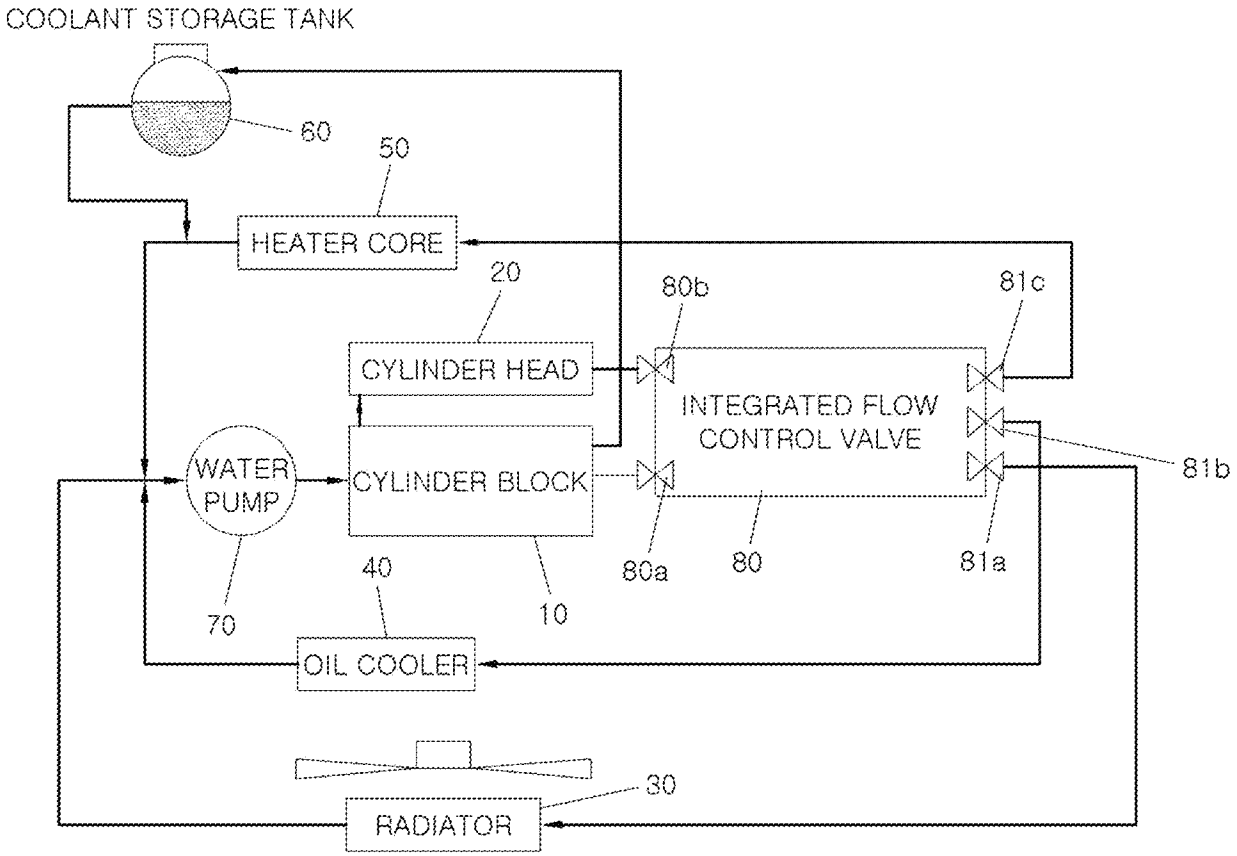

FIG. 8C is a diagram illustrating an example of a coolant flow when the operation condition of the engine is switched from a warm condition to a high-temperature condition. This is a state in which the temperature of coolant exceeds a second temperature and is less than or equal to a third temperature (e.g., higher than 90° C. and less than or equal to 105° C.). in the instant state, the controller 90 controls the integrated flow control valve apparatus 80 to open the first outlet port 81*a* connected to the radiator 30 so that the coolant is supplied to the radiator 30. Thus, it is possible to rapidly cool the coolant using the radiator 30.

The operating states illustrated in FIGS. 8A to 8C are in the normal practical operating range. Accordingly, an improvement in fuel efficiency is more important than engine durability and combustion stability. Therefore, the controller 90 controls the integrated flow control valve apparatus 80 such that the coolant in the engine flows into a form of a parallel flow by closing the first inlet port 80*a* for introduction of the coolant discharged from the cylinder block 10 and opening the second inlet port 80*b* for introduction of the coolant discharged from the cylinder head 20. As a result, it is possible to realize the substantial separation cooling of the cylinder block 10 and the cylinder head 20.

Figure 8D:
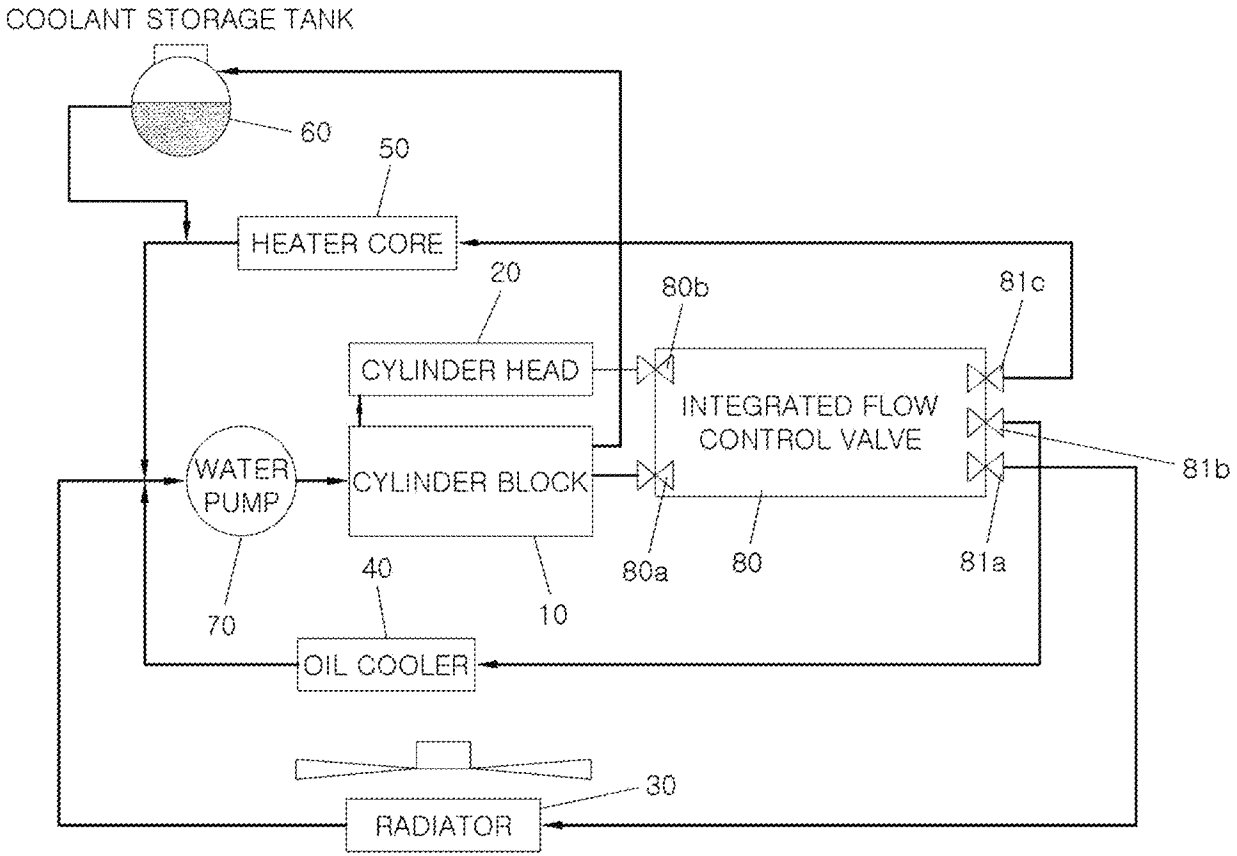

FIG. 8D is a diagram illustrating an example of a coolant flow when the operation condition of the engine is switched from a warm condition to a high-temperature and high-load operation condition. This is a state in which the temperature of coolant exceeds a second temperature and is less than or equal to a third temperature (e.g., higher than 90° C. and less than or equal to 105° C.). in the instant state, it is more important to maintain engine durability and combustion stability rather than an improvement in fuel efficiency. Therefore, the controller 90 controls the integrated flow control valve apparatus 80 such that the coolant in the engine flows into a form of a cross flow by opening the first inlet port 80*a* for introduction of the coolant discharged from the cylinder block 10 and closing the second inlet port 80*b* for introduction of the coolant discharged from the cylinder head 20. As a result, it is possible to release the substantial separation cooling of the cylinder block 10 and the cylinder head 20.

Figure 9:
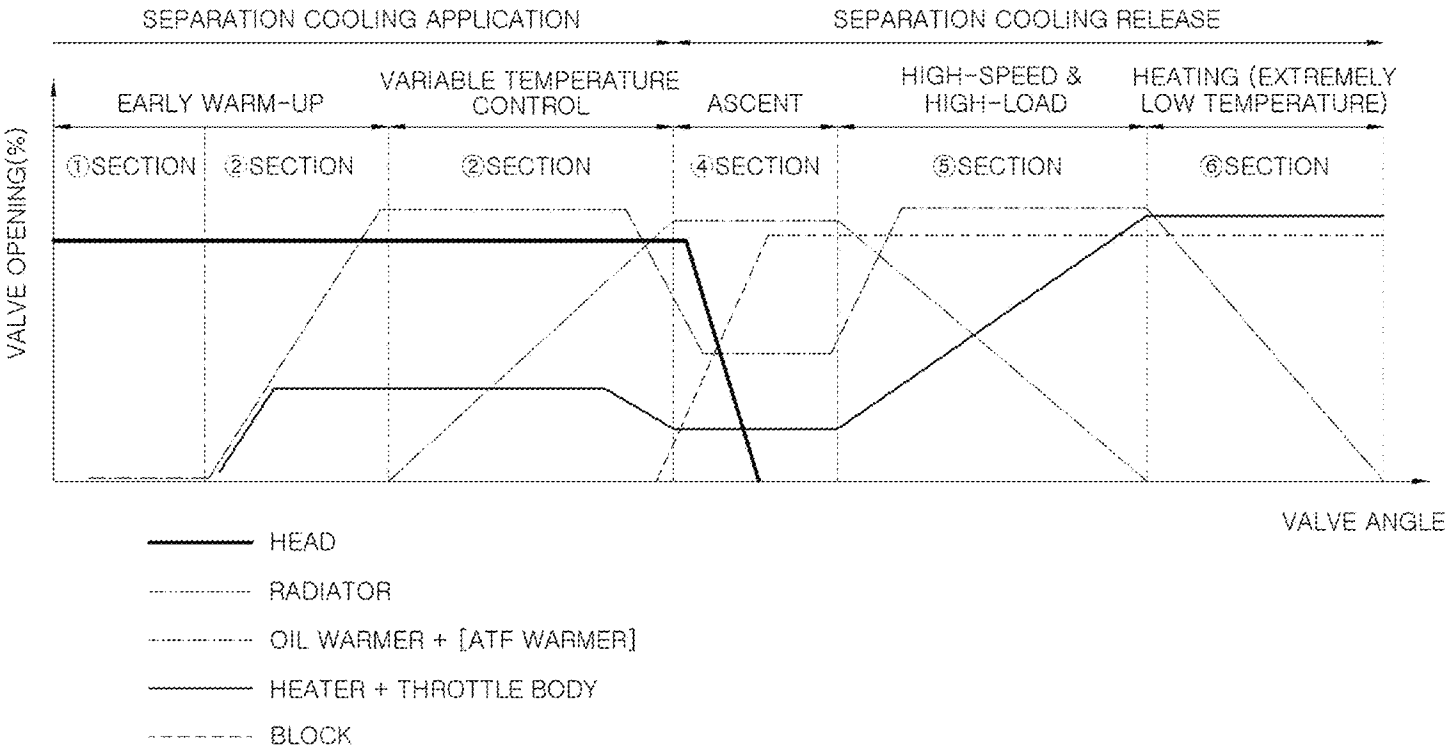
FIG. 9 is a diagram illustrating opening amounts of ports communicating with respective components of the engine cooling system with respect to the valve angle (°) of the integrated flow control valve apparatus according to the exemplary embodiment of the present invention.

FIG. 9 is a diagram illustrating the opening amounts of the ports communicating with the respective components of the engine cooling system with respect to the valve angle (°) of the integrated flow control valve apparatus according to the exemplary embodiment of the present invention. Section ① illustrated in FIG. 9 corresponds to the operating state of the engine described with reference to FIG. 8A. Section ② illustrated in FIG. 9 corresponds to the operating state of the engine described with reference to FIG. 8B. Section ③ illustrated in FIG. 9 corresponds to the operating state of the engine described with reference to FIG. 8C. Sections ④ and ⑤ illustrated in FIG. 9 correspond to the operating state of the engine described with reference to FIG. 8D. Section ⑥ illustrated in FIG. 9 is a state in which the temperature of outside air is extremely low. Therefore, the opening amount of the third outlet port 81*c* for regulating the flow rate of the coolant to the heater core 50 is maximized to maximize heating efficiency, whereas the opening amount of the second outlet port 81*b* for regulating the flow rate of the coolant to the oil cooler 40 is reduced to prevent oil from overheating.

Figure 10A:
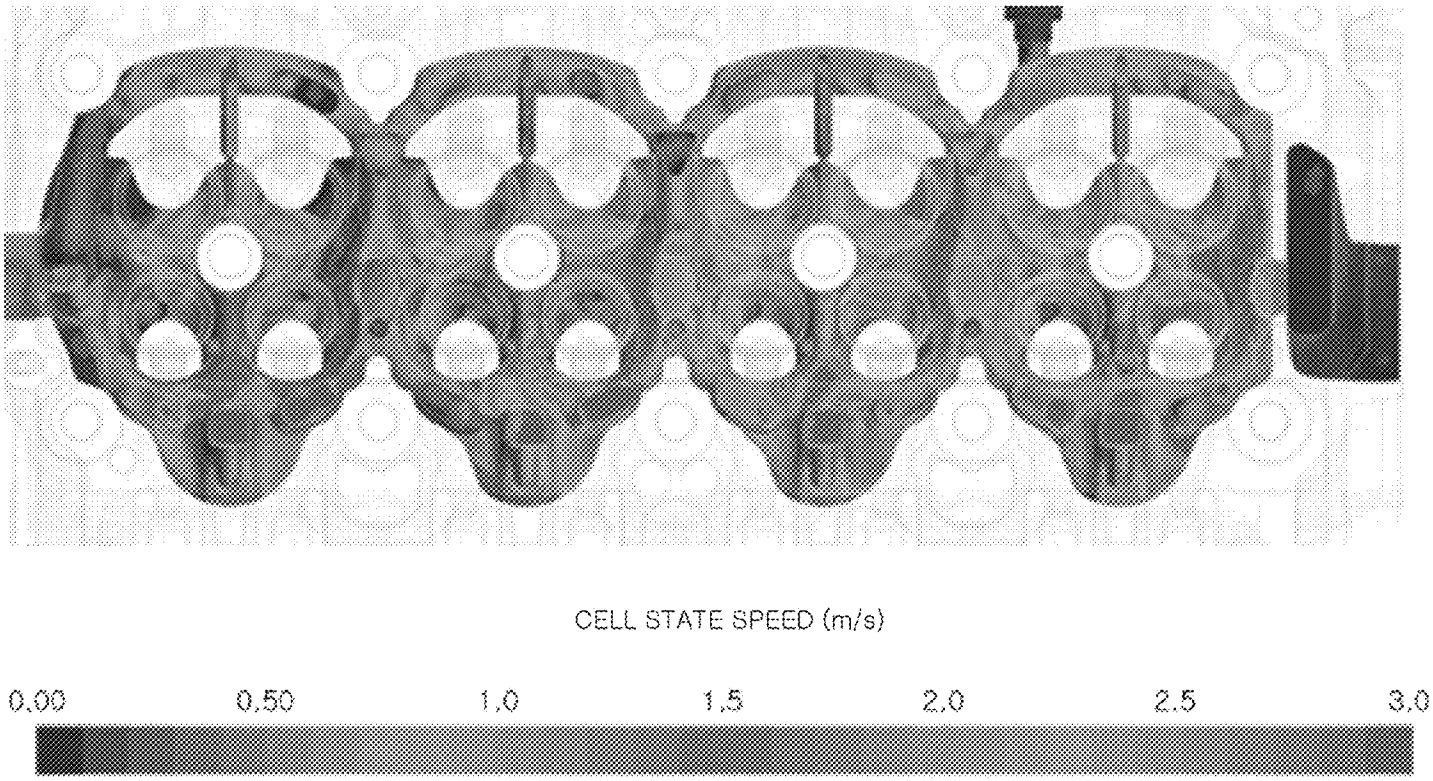
FIG. 10A and FIG. 10B are views illustrating the parallel flow of coolant in the cylinder block and the cylinder head of the engine cooling system according to an exemplary embodiment of the present invention.
Figure 10B:
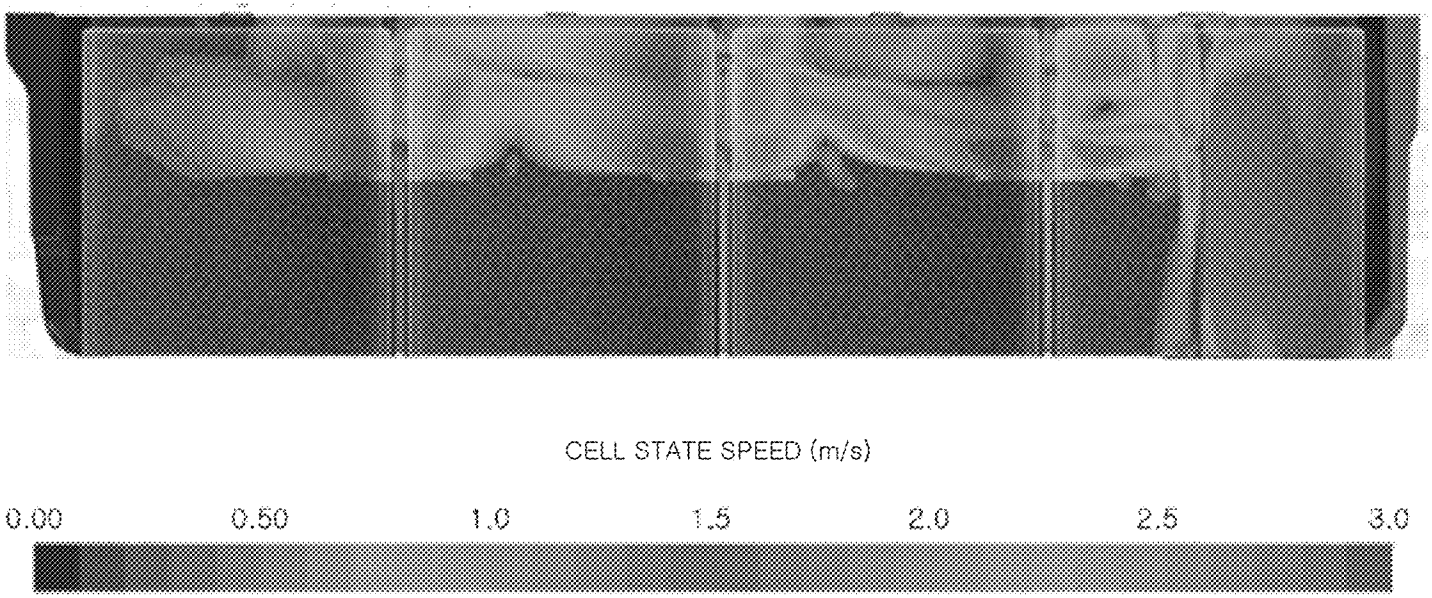
Figure 11A:
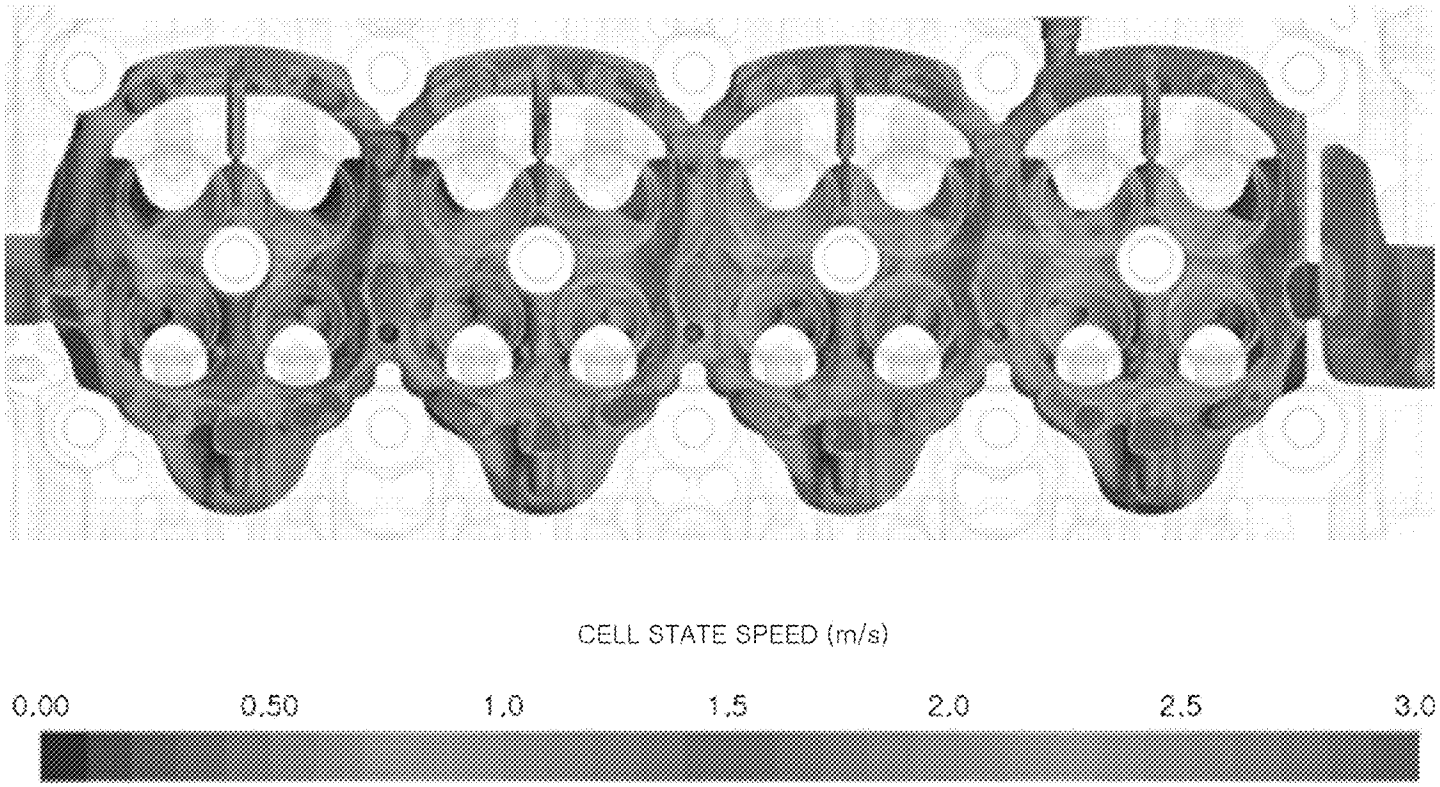
FIG. 11A and FIG. 11B are views illustrating the cross flow of coolant in the cylinder block and the cylinder head of the engine cooling system according to an exemplary embodiment of the present invention.
Figure 11B:
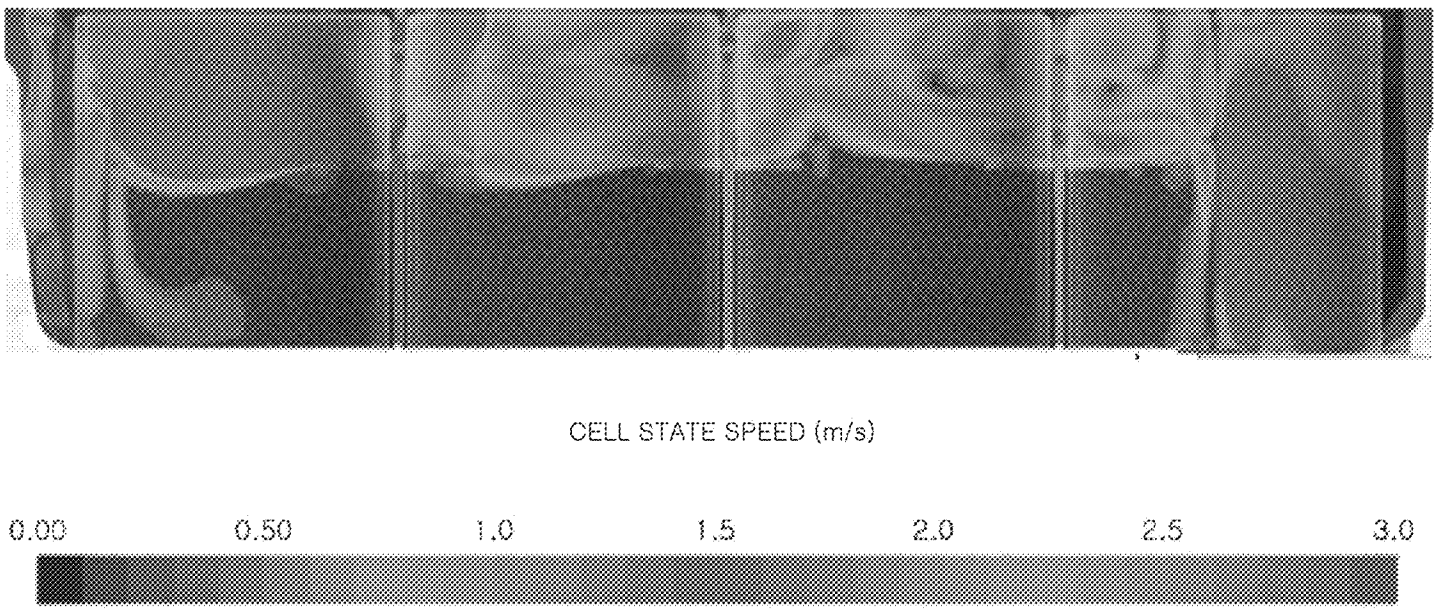

FIG. 10A and FIG. 10B are views illustrating the parallel flow of coolant in the cylinder block and the cylinder head of the engine cooling system according to an exemplary embodiment of the present invention. FIG. 11A and FIG. 11B are views illustrating the cross flow of coolant in the cylinder block and the cylinder head of the engine cooling system according to an exemplary embodiment of the present invention.

FIGS. 10A and 11A illustrate the respective parallel and cross flows of coolant in the cylinder head of the cooling system according to the exemplary embodiment of the present invention, when viewed from the top. FIGS. 10B and 11B illustrate the flow of coolant in the cylinder block of the cooling system according to the exemplary embodiment of the present invention, when viewed from the side thereof.

It may be seen in FIG. 10A that the flow of coolant is relatively fast in the vicinity of the intake valve due to the parallel flow. Thus, it may be seen that the cooling of the intake port and the intake side of the combustion chamber is enhanced, which can bring about an effect of reducing an occurrence of knocking.

It may be seen in FIG. 10B that the strong warm block is formed and the coolant is stagnant in the lower portion of the cylinder block due to the parallel flow. Furthermore, it may be seen that the flow in the upper portion of the cylinder block is significantly slow compared to the cross flow illustrated in FIG. 10B. As a result, the temperature of the cylinder liner 300 in the lower portion of the cylinder block 200 is increased by 15 to 20° C. or more according to the region, which can bring about an excellent piston friction reduction effect as compared with the related art.

It may be seen in FIG. 11A that the flow of coolant is relatively fast in the vicinity of the exhaust valve due to the cross flow. Thus, it may be seen that the cooling of the region between the exhaust valves is enhanced, which can bring about effects of improving engine durability and reducing a maximum temperature in the combustion chamber. Furthermore, it may be seen that the difference in speed distribution of coolant in each combustion chamber is reduced compared to FIG. 10A. Thus, it may be seen that the difference in temperature between the combustion chambers is reduced, which can bring about an effect of improving knocking stability.

It may be seen in FIG. 11B that the flow of coolant is relatively fast in the upper portion of the cylinder block due to the cross flow. Thus, it may be seen that the cooling of the upper portion of the cylinder block is enhanced, which can bring about effects of suppressing an occurrence of knocking and improving engine durability. Furthermore, it may be seen that the warm block is formed for the stagnation of coolant in the lower portion of the cylinder block even though an effect is lower compared to FIG. 10B.

Although the present invention has been described with reference to the embodiment(s) illustrated in the drawings, the present invention is by way of example only and the present invention is not limited to the above-mentioned embodiments.

For example, the engine cooling system according to the exemplary embodiment of the present invention includes the radiator 30, the oil cooler 40, the heater core 50, the coolant storage tank 60, and the water pump 70, but the present invention is not limited thereto. The engine cooling system may further include an exhaust gas recirculation (EGR) cooler for cooling recirculating gas or a cooler for cooling a throttle body in an exhaust gas recirculation (EGR) system.

In the exemplary embodiment described with reference to FIG. 6, the first inlet port 80*a* and the second inlet port 80*b* are symmetrically mounted at an angle of 180° so that the second inlet port 80*b* is closed while the first inlet port 80*a* is opened, whereas the second inlet port 80*b* is opened while the first inlet port 80*a* is closed. However, the present invention is not limited thereto. As long as the state in which the first inlet port 80*a* is opened and the second inlet port 80*b* is closed and the state in which the first inlet port 80*a* is closed and the second inlet port 80*b* is opened are implemented, there may be a state in which the first inlet port 80*a* and the second inlet port 80*b* are simultaneously opened.

In accordance with exemplary embodiments of the present invention, it is possible to realize the cross flow of coolant at the time of cooling the engine by controlling only the flow of coolant discharged from the cylinder block and the cylinder head.

The flow of coolant in the engine may be easily switched between the parallel flow and the cross flow by controlling the integrated flow control valve apparatus. This makes it possible to increase fuel efficiency by switching the flow of coolant to the parallel flow in the practical operation range and to improve combustion stability and engine durability by realizing the cross flow in the high-speed and high-load range.

It is possible to exhibit the piston friction reduction effect superior to the related art by increasing the lower temperature of the block since the coolant is efficiently stagnant in the lower portion of the block.

It is possible to improve knocking characteristics by improving the flow rate of coolant in the upper portion of the block and lowering the upper temperature of the block, resulting in an improvement of output and fuel efficiency in the low/middle-speed and high-load range.

The fuel efficiency of the vehicle may be significantly improved only by partially changing the design of the conventional integrated flow control valve apparatus, achieving high fuel efficiency at low cost.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An engine cooling system comprising:

an engine including a cylinder block and a cylinder head mounted above the cylinder block;

an integrated flow control valve apparatus into which coolant having cooled the cylinder block and coolant having cooled the cylinder head are selectively introduced through a plurality of coolant inlets of the integrated flow control valve apparatus and from which the coolant is selectively discharged through a coolant outlet of the integrated flow control valve apparatus so that the coolant circulates in the engine cooling system; and a controller configured to control opening and closing of the integrated flow control valve apparatus, wherein the controller is configured to control the integrated flow control valve apparatus to block an introduction of the coolant from the cylinder head and allow an introduction of the coolant from the cylinder block in a predetermined high-speed and high-load operation range and to allow the introduction of the coolant from the cylinder head and block the introduction of the coolant from the cylinder block in a predetermined normal operating range.

2. The engine cooling system of claim 1, wherein a block insert is provided in a lower portion of a block water jacket of the cylinder block to partially restrict a flow of the coolant under the cylinder block.

3. The engine cooling system of claim 1, wherein the coolant outlet includes a plurality of coolant outlets, and wherein the plurality of coolant outlets is fluidically connected to at least one of a radiator, a heater core, and an oil cooler, and the engine cooling system further includes a water pump for circulating the coolant.

4. The engine cooling system of claim 3, wherein in a response that the engine is in a cold state in which a temperature of the coolant is less than or equal to a first temperature, the controller is configured to control the integrated flow control valve apparatus to close the plurality of coolant outlets and stop the circulation of the coolant.

5. The engine cooling system of claim 3, wherein in a response that the engine is in a warm state in which a temperature of the coolant exceeds a first temperature and is less than or equal to a second temperature, the controller is configured to control the integrated flow control valve apparatus to open a coolant outlet of the integrated flow control valve apparatus for discharging the coolant to the oil cooler or the heater core.

6. The engine cooling system of claim 3, wherein in a response that the engine is in a hot state in which a temperature of the coolant exceeds a second temperature and is less than or equal to a third temperature, the controller is configured to control the integrated flow control valve apparatus to open a coolant outlet for discharging the coolant to the radiator.

7. The engine cooling system of claim 3, wherein in a response that the engine is in a hot state in which a temperature of the coolant exceeds a third temperature, the controller is configured to control the integrated flow control valve apparatus to close a first coolant inlet among the plurality of coolant inlets for the introduction of the coolant from the cylinder head and open a second coolant inlet among the plurality of coolant inlets for the introduction of the coolant from the cylinder block.

8. The engine cooling system of claim 1, wherein the cylinder head is mounted above the cylinder block with a gasket interposed therebetween, the gasket having a coolant hole.

* * * * *